US005997404A

United States Patent [19]

Sardo

[11] Patent Number: 5,997,404

[45] Date of Patent: Dec. 7, 1999

[54] RACKING SYSTEM FOR ARRANGING POOL BALLS

[76] Inventor: Louis Sardo, 1629 Verdugo Blvd., La Canada, Calif. 91011

[21] Appl. No.: 09/221,724

[22] Filed: Dec. 29, 1998

[51] Int. Cl.[6] ..... A63D 15/00

[52] U.S. Cl. ..... 473/40; 473/21; 473/26

[58] Field of Search ..... 473/40, 21, 26, 473/73, 75

[56] References Cited

U.S. PATENT DOCUMENTS

| | | | |
|---|---|---|---|
| 464,475 | 12/1891 | Sweet | 473/40 |
| 1,052,461 | 2/1913 | Chase | 473/40 |
| 3,253,826 | 5/1966 | Cook | 473/40 |
| 3,992,005 | 11/1976 | Richey | 473/40 |
| 4,469,328 | 9/1984 | Pacitti | 473/40 |
| 5,376,054 | 12/1994 | Kwasny et al. | 473/40 |
| 5,601,495 | 2/1997 | Silverman | 473/40 |
| 5,735,750 | 4/1998 | Silverman | 473/40 |

*Primary Examiner*—Jeanette Chapman
*Attorney, Agent, or Firm*—Goldstein & Canino

[57] ABSTRACT

A racking device, for racking a plurality of pool balls upon a pool table have a felt top surface, comprising a rack for containing the balls, a pressure base located above the rack, and a sweeper frame capable of relative vertical movement with respect to the rack. A plurality of sweeper pins extend vertically downward from the sweeper frame, which each selectively engage one of the pool balls. A lever causes the sweeper pins to move downward toward the balls to engage the balls and urge them toward each other. A pressure pin is associated with each of the balls, which firmly press upon the apexes of the balls to press them downward into the felt top surface so that the balls hold their positions in a tight, racked formation even after the racking device has been lifted upward and away from the balls.

20 Claims, 4 Drawing Sheets

RACKING SYSTEM FOR ARRANGING POOL BALLS

BACKGROUND OF THE INVENTION

The invention relates to a system for racking pool balls on a pool table. More particularly, the invention relates to a racking system that allows players to tightly arrange pool balls in a compact formation on the pool table.

Pool games are extremely popular with people of all ages. Most games require that pool balls (often fifteen for playing "eight ball", but sometimes nine for the game of "nine ball") be arranged into a triangular or a diamond shaped pattern. The balls are arranged in a manner such that the apex of the formed diamond is located near a pre-marked spot on the pool table, which serves as a marker for placing the racked balls.

The pool balls must be arranged in a tight and compact formation to ensure that when it is first "broken", the balls do not deviate from their predictable lines of travel merely because of a poor racking of the pool balls. Unfortunately, there is no existing system that provides pool players with an easy mechanism for obtaining a tight formation of the desired shape on the pool table.

To rack the balls, most people use a triangular pool rack that holds the balls in its interior portion. The rack is removed once the balls are organized in a formation that roughly resembles the desired shape. Unfortunately, the size of the pool balls often lacks uniformity, which makes it difficult to properly rack the balls into a tight formation. As a result, the first player to break the rack of balls is at a disadvantage in that the improperly racked balls do not respond as would be anticipated from a properly racked set of pool balls.

Other devices have been proposed for the purpose of automatically racking pool balls or assisting therewith. Unfortunately, all of these devices operate by engaging the balls "en masse" in an attempt to press them together.

While these various devices attempt to provide simplified means for properly racking pool balls, none of these guarantee a tight and even formation. Additionally, these devices have a complicated structure and are expensive in construction, yet still fail to provide the desired results. Therefore, while these prior art units may be suitable for the particular purpose employed, or for general use, they would not be as suitable for the purposes of the present invention as disclosed hereinafter.

SUMMARY OF THE INVENTION

It is an object of the invention to provide a racking device for racking pool balls in a tight and compact manner on top of the pool table. Accordingly, each of the balls is individually engaged to urge the balls toward each other, and into a stable position on the pool table felt.

It is another object of the present invention to provide a simple mechanism for racking pool balls in a tight and even formation by providing a racking device that conforms to the shape and size of each individual pool ball. Accordingly, a racking device is disclosed that utilizes a plurality of sweeper pins to move the pool balls together into a tight formation, such that adjoining balls touch each other. The balls are then firmly pressed into the felt of the pool table by a plurality of pressure pins. Once the desired formation has been achieved, the racking device is removed without disturbing the racked pool balls.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims and their legal equivalents.

BRIEF DESCRIPTION OF THE DRAWINGS

The above and other aspects, features and advantages of the present invention will be more apparent from the following detailed description thereof, which is presented in conjunction with the following drawings, wherein corresponding reference characters indicate corresponding components throughout the drawing figures.

DETAILED DESCRIPTION OF THE PREFERRED EMBODIMENTS

FIGS. 1–4 show a racking device 10 that tightly arranges a plurality of pool balls on top of a pool table having a felt top surface.

Figure 2:
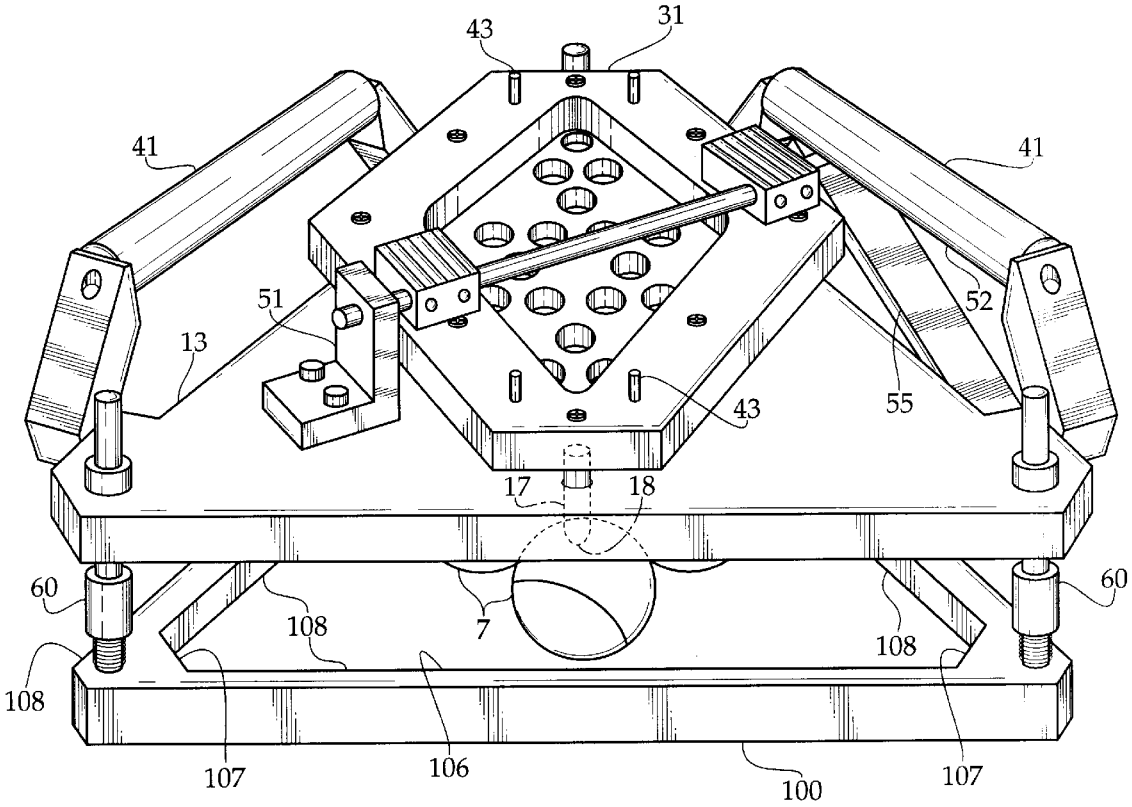
FIG. 2 is a diagrammatic perspective view of the racking device, viewed from the rear.

According to the invention, the racking device 10 comprises a pool rack 100 that has an interior 106, as shown in FIG. 2. The pool rack 100 has three side walls 108, wherein adjoining side walls 108 join together to form a corner 107. The interior 106 of the pool rack 100 houses a plurality of pool balls 7 therein for arranging the balls 7 in the desired formation. According to the invention, the racking device 10 engages each individual pool ball 7 to obtain a tight and compact formation. While the present invention racks the balls 7 in a diamond shaped formation (comprising nine balls), the scope of the present invention is not limited by this aspect. Accordingly, it is possible to rack the balls in a triangular shaped formation (comprising fifteen balls) through minor adaptation of the present invention.

Figure 4:
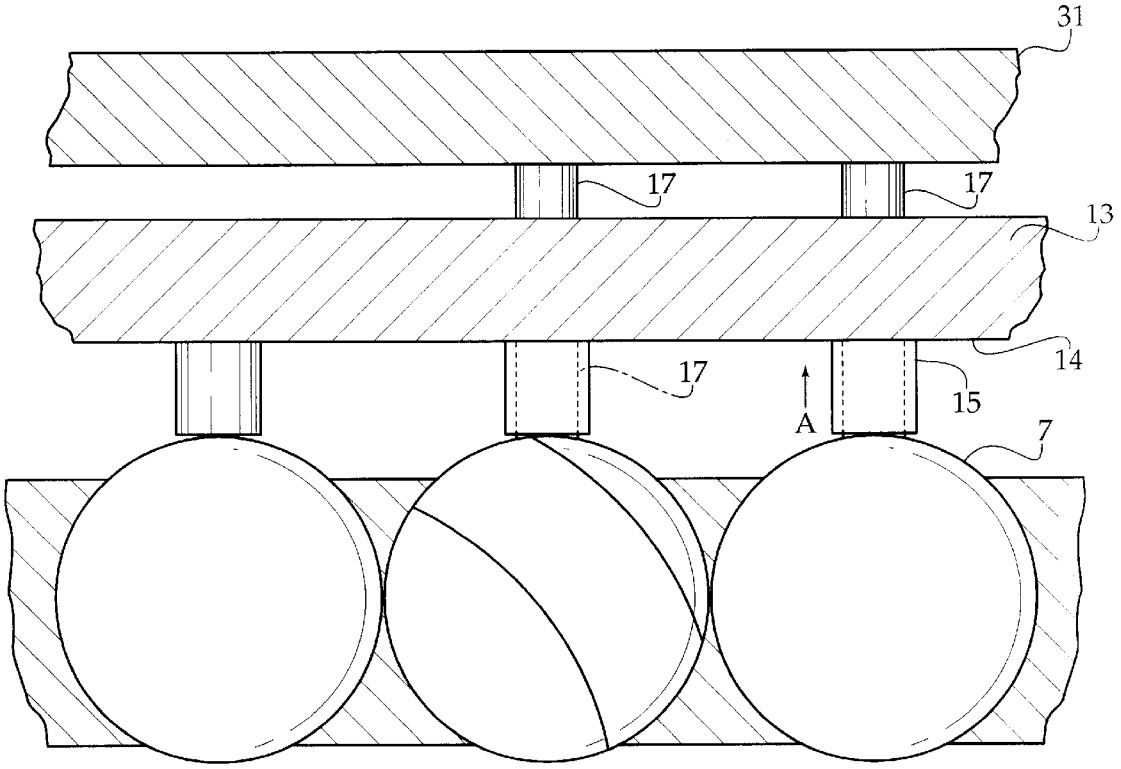
FIG. 4 provides a cross-sectional view taken in the direction of arrows 4—4 in FIG. 3.

As shown in FIG. 4, the racking device 10 comprises a pressure base 13 with a bottom surface 14. A plurality of pressure pins 15 are mounted to the bottom surface 14, extending vertically downward therefrom. The pressure pins 15 are spring mounted to ensure that they selectively move upward in the direction of arrow A when pressed on top of the pool balls 7, but still exert pressure upon the pool balls 7. The pressure pins 15 are positioned so that they each engage one of the pool balls 7 at the very top point thereof.

The racking device 10 has a pair of handles 41 that are mounted to and above the pressure base 13, as shown in FIG. 2. The handles 41 are substantially parallel to the pressure base 13, such that when the handles are pushed downward, the pressure base 13 moves downward and causes the pressure pins 15 to press on top of the pool balls 7.

The racking device 10 is provided with a sweeper arm frame 31 that lies parallel to the pressure base 13. A plurality of sweeper frame guide pins 43 are mounted to the pressure base 13 and extend through the sweeper arm frame 31. The sweeper frame guide pins 43 are mounted at approximately ninety degrees from the pressure base 13 to allow the sweeper arm frame 31 to move toward and away from the pressure base 13, and to ensure that the sweeper arm frame 31 moves in a plane that is substantially parallel to the pressure base 13.

As shown in FIG. 4, the sweeper arm frame 31 has a plurality of sweeper pins 17 extending vertically downward therefrom. The sweeper pins 17 are spring mounted to ensure that the sweeper pins 17 can move upward when they contact the sides of the pool balls 7. Each of the sweeper pins 17 has a conical tip 18, as shown in FIG. 2.

Figure 1:
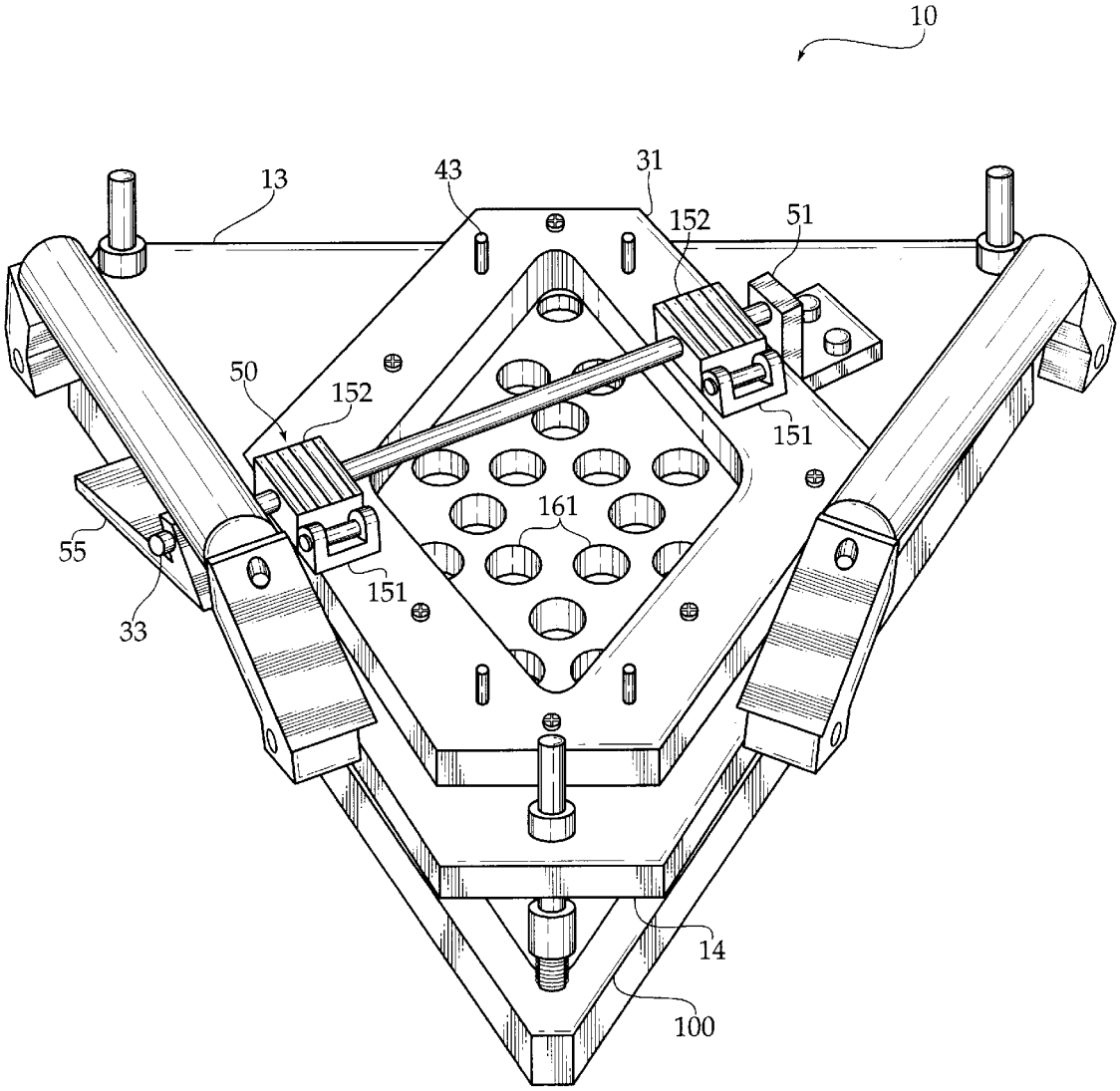
FIG. 1 is a diagrammatic perspective view of the racking device, viewed from the front.

Each handle 41 has a bottom surface 52. A sweeper lever 55 is pivotably mounted from the bottom surface 52 of one of the pair of handles 41. As shown in FIG. 1, the sweeper lever 55 is provided with an axle 33 that extends across the sweeper arm frame 31.

A pair of sweeper activators 50 are mounted on top of the sweeper arm frame 31. The sweeper activator 50 has a front portion 151 and a back portion 152, wherein the axle 33 extends through the back portion 152 such that rotation by the axle 33 causes the back portion 152 to rotate in like direction. The front portion 151 is securely affixed to the sweeper arm frame 31, while the back portion 152 normally lies in a plane that is substantially parallel to the sweeper arm frame 31.

An axle mount 51 is provided on top of the pressure base 13 near the other handle 41, which secures the axle 33 on the side opposite from the sweeper lever 55 pivotably mounted from the first handle 41. Since the axle 33 is attached to the sweeper arm frame 31, mounting the axle 33 to the axle mount 51 ensures that the sweeper arm frame 31 securely remains parallel to the pressure base 13.

According to the invention, when the sweeper lever 55 is squeezed, the axle 33 rotates clockwise and raises the back portion 152, which causes the front portion to pivot downward and move the sweeper arm frame 31 vertically downward. When the sweeper arm frame 31 moves downward, the sweeper pins 17 also move downward and each engages one of the pool balls off-center, pushing the sides of the pool balls 7, causing the pool balls 7 to move inward against each other.

The sweeper lever 55 is spring mounted, such that when the sweeper lever 55 is released, it moves downward and away from the bottom surface 52 of the handle 41, which causes the sweeper arm frame 31 to be raised upward and the sweeper pins 17 to release from contact with the pool balls 7.

A plurality of springs are securely mounted between the sweeper arm frame 31 and the pressure base 13. Thus, when the sweeper lever is released, the plurality of springs push the sweeper arm frame 31 upward and away from the pressure base 13.

The racking device 10 has a plurality of guide assemblies 60 that secure the pressure base 13 to the side walls 108 of the pool rack 100, as shown in FIG. 2. It is preferable that the racking device 10 be provided with three guide assemblies 60 that are positioned at the corners 107 of the pool rack 100. According to the invention, the guide assemblies 60 ensure that the pressure base 13 moves upward and downward toward and away from the rack 100 in a plane that is substantially parallel to the pool rack 100 and the pool balls 7 placed in the interior 106 of the pool rack 100.

Figure 3:
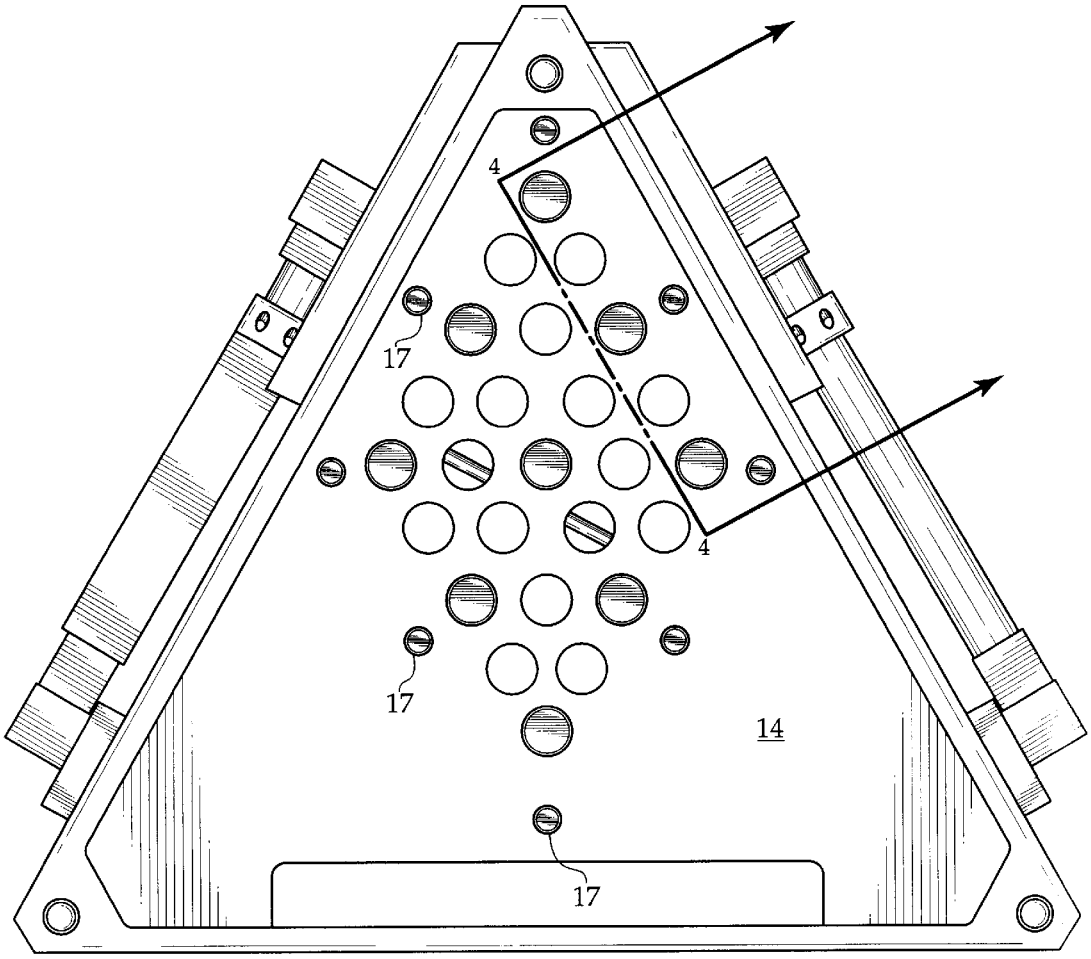
FIG. 3 provides a bottom plan view of the racking device.

FIG. 3 provides a bottom view of the preferred embodiment of the racking device 10, which arranges the balls in a diamond shaped formation for playing "nine ball." As is well known to most pool players, nine ball requires that nine pool balls 7 be arranged in a diamond shaped formation, wherein eight pool balls 7 are placed surrounding one pool ball 7 in the center thereof. Accordingly, the racking device 10 has eight sweeper pins 17 that extend downward through a circular hole provided in the pressure base 13. Each sweeper pin 17 corresponds to the location of a pool ball 7 on the periphery of the diamond shaped formation. The racking device 10 is provided with nine pressure pins 15 that correspond to the location of each pool ball 7 in the diamond shaped formation, and are each positioned to engage one of the pool balls at its apex.

According to the invention, to obtain the desired pool ball formation, an appropriate number of pool balls 7 are placed in the interior 106 of the pool rack 100 on top of a pool table. The pool balls 7 are arranged in a configuration that roughly resembles the shape desired.

Next, the handles 41 are pushed towards the pool balls 7 on the pool table and the sweeper lever 55 is squeezed against the handle 41. As the sweeper lever 55 moves upward, the sweeper arm frame 31 moves downward toward the pressure base 13, and the sweeper pins 17 each engage one of the pool balls off center and press against the side of the pool ball 7, which together pushes the pool balls 7 toward the center such that there is no gap between the pool balls 7. As the balls move together, a tighter pool ball formation is obtained. Since the sweeper pins 17 are spring mounted to the sweeper arm frame 31, the push force exerted by the sweeper pins 17 corresponds to the exact amount needed for moving the balls 7 into the tighter pool ball formation.

As shown in FIG. 1, the pressure base 13 has a plurality of viewing holes 161, which allows a use to view the pool balls 7 from the top as they are tightly arranged in the desired formation.

Once the balls 7 are tightly racked, the handles 41 are pushed downward for a few more seconds to press the pressure pins 15 on top of the pool balls 7 of the tightly arranged pool ball formation and push the balls 7 into the felt of the pool table. As the balls 7 are pressed into the felt, the sweeper lever 55 is released to allow the sweeper pins 17 to move upward and release contact with the pool balls 7.

Once the user concludes that the pool balls 7 have been appropriately racked and firmly pressed into the felt of the table by looking through the viewing holes 161, pressure on the handles 41 is released and the racking device 10 is removed upward from the pool table. The previous firm pressing of the pool balls 7 into the felt of the pool table ensures that the balls 7 do not move away from each other as the racking device 10 is removed therefrom. As shown in FIG. 2, the racked pool balls 7 do not actually touch the side walls 108 of the pool rack 100, which helps ensure that the removal of the racking device 10 does not disturb the pool ball formation.

Many specific details contained in the above description merely illustrate some preferred embodiments and should not be construed as a limitation on the scope of the invention. Accordingly, many other variations are possible within the spirit of the present invention, limited only by the scope of the appended claims.

What is claimed is:

1. A racking device for firmly arranging a plurality of pool balls in a desired formation on a pool table having a felt top surface, comprising:

a pool rack having a plurality of side walls, wherein said side walls join together to form an interior;

a pressure base mounted to the pool rack, said pressure base having a bottom surface;

a plurality of pressure pins mounted on said bottom surface of said base, each of said pressure pins capable of firmly pushing one of the pool balls into the felt of the pool table;

a pair of handles having a bottom surface, said handles mounted to the pressure base;

a sweeper arm frame mounted on top of said pressure base;

a sweeper attached to the sweeper arm frame lever mounted to the bottom surface of said handles for selectively moving the sweeper arm frame downward against the pressure base; and a plurality of sweeper pins mounted from said sweeper arm frame, said sweeper pins extending downward such that the sweeper pins push the pool balls toward the adjoining balls when the sweeper arm frame moves downward toward the pressure base.

2. The racking device of claim 1, further comprising:

an axle securely mounted from said sweeper lever, said axle extending across the sweeper arm frame; and a pair of sweeper activators mounted on said sweeper arm frame, said sweeper activators securely attached to the axle extending across the sweeper arm frame.

3. The racking device of claim 1, further comprising a plurality of guide assemblies, wherein the guide assemblies secure the pressure base to the side walls of said pool rack.

4. The racking device of claim 3, further comprising an axle mount opposite said sweeper lever on top of the pressure base for securing the axle extending across the sweeper arm frame.

5. The racking device of claim 4, wherein the sweeper activator comprises a front portion and a back portion, said front portion being securely affixed to the sweeper arm frame and said back portion lying on top of the sweeper arm frame.

6. The racking device of claim 5, wherein the axle securely extends through the back portion of the sweeper activator, such that rotation by the axle causes the back portion to rotate in like direction.

7. The racking device of claim 5, further comprising a plurality of sweeper frame guide pins that are mounted on the pressure base at a ninety degree angle, said sweeper frame guide pins extending through the sweeper arm frame for ensuring that the sweeper arm frame moves parallel to the pressure base.

8. The racking device of claim 7, wherein the sweeper pins are spring mounted from said sweeper arm frame, such that said sweeper pins move upward when they contact the sides of said pool balls.

9. The racking device of claim 1, wherein the sweeper pins are spring mounted from said sweeper arm frame, such that said sweeper pins move upward when they contact the sides of said pool balls.

10. The racking device of claim 1, wherein the pressure pins are spring mounted from said pressure base for allowing the pressure pins to move upward when pressed on top of the pool balls.

11. The racking device of claim 3, wherein the racking device is provided with three guide assemblies that are located at the corners of the pool rack.

12. The racking device of claim 11, wherein the racking device is provided with nine pressure pins arranged in a diamond formation.

13. The racking device of claim 12, wherein the racking device is provided with eight sweeper pins arranged in a diamond formation.

14. The racking device of claim 12, wherein the pressure base is provided with a plurality of viewing holes for allowing one to see the pool ball formation from the top.

15. A racking device, for racking a plurality of pool balls, each having an apex, into a tight racked formation, upon a pool table having a felt top surface, comprising:

a pressure base;

a plurality of pressure pins mounted beneath the pressure base, the pressure pins positioned so that they each engage the apex of one of the balls when in the tight racked formation; and a plurality of sweeper pins mounted to extend vertically beneath the pressure base, each of the sweeper pins is capable of vertical movement therethrough to selectively engage one and only one of the pool balls off-center from above and urge that pool ball inward so that the sweeper pins together press the balls tightly against each other.

16. The racking device as recited in claim 15, wherein each sweeper pin has a conical tip.

17. The racking device as recited in claim 16, further comprising a sweeper frame mounted for vertical relative movement with respect to the pressure base, a pair of handles mounted to the pressure base, and a lever for causing the sweeper frame to move toward the pressure base for moving the sweeper pins downward to engage the balls.

18. The racking device as recited in claim 17, wherein the lever is located adjacent to one of the handles, so that the lever may be actuated by squeezing the lever toward that handle.

19. The racking device as recited in claim 18, wherein the pressure base further has a plurality of viewing holes for allowing a user to see the position of the balls as they are being racked.

20. A method of tightly arranging a plurality of pool balls on a pool table having a felt top using a racking device comprising a pool rack, a pressure base having a bottom surface, a plurality of pressure pins extending downward from the bottom surface of the pressure base, a sweeper arm frame secured parallel to the pressure base, a pair of handles mounted on the pressure base, a sweeper lever attached to one of the pair of handles, an axle mounted from the sweeper lever that secures a pair of sweeper activators, the sweeper activators mounted on the sweeper arm frame, a plurality of sweeper pins mounted from said sweeper arm frame and extending downward through the pressure base, said method comprising the steps of:

(a) placing the appropriate number of pool balls in the interior portion of the pool rack;

(b) arranging the pool balls in a rough formation of the desired shape on the felt of the pool table;

(c) pushing the handles downward to push the pressure base downward for pressing the pressure pins on top of the pool balls;

(d) contacting the pool balls from above with the sweeper pins and pushing them inward such that there is no gap between adjoining balls;

(e) releasing contact of the sweeper pins from the sides of the pool balls; and (f) terminating the push exerted on the pressure base for allowing the pressure pins to release contact of the pressure pins from the pool balls.

* * * * *